United States Patent [19]

Helinski et al.

[11] Patent Number: 4,759,647

[45] Date of Patent: Jul. 26, 1988

[54] DUAL PITCH IMPACT PRINTER

[75] Inventors: Edward F. Helinski, Johnson City; Jack L. Zable, Vestal, both of N.Y.

[73] Assignee: International Business Machines Corporation, Armonk, N.Y.

[21] Appl. No.: 921,509

[22] Filed: Oct. 22, 1986

[51] Int. Cl.[4] ..... B41J 9/12

[52] U.S. Cl. ..... 400/157.1; 101/93.48; 101/93.09; 101/93.14; 400/82; 400/303; 400/146

[58] Field of Search ..... 400/157.1, 157.4, 146, 400/82, 3.3; 101/93.09, 93.48, 93.13, 93.14

[56] References Cited

U.S. PATENT DOCUMENTS

| | | | |
|---|---|---|---|
| 3,715,978 | 2/1973 | Raider | 101/93.13 |
| 4,150,619 | 4/1979 | Hasler | 101/93.14 |
| 4,399,748 | 8/1983 | Thorne | 101/93.14 |

FOREIGN PATENT DOCUMENTS

| | | | |
|---|---|---|---|
| 3511298 | 8/1986 | Fed. Rep. of Germany | 400/157.1 |
| 44524 | 4/1978 | Japan | 101/93.14 |
| 91269 | 6/1982 | Japan | 400/146 |
| 114957 | 7/1983 | Japan | 101/93.13 |

OTHER PUBLICATIONS

"Dual Density Printing", IBM Tech. Disclosure Bulletin, vol. 29, No. 4, pp. 1752–1753, 9–86.

Gamblin, "Sharing Print Hammer . . . ", IBM Tech. Disclosure Bulletin, vol. 13, No. 7, pp. 1833–1834, 12–70.

"Mini Printing Line Printer", IBM Tech. Disclosure Bulletin, vol. 29, No. 3, pp. 1049–1051, 8–86.

Martin et al., "Control of Printers . . . ", IBM Tech. Disclosure Bulletin, vol. 18, No. 1, pp. 89–90, 6–75.

*Primary Examiner*—William Pieprz

*Attorney, Agent, or Firm*—John S. Gasper; Elmer W. Galbi

[57] ABSTRACT

A printer for printing both standard pitch and condensed pitch characters which includes print hammer faces which have a single wide section for standard pitch characters and a double wide section for printing condensed pitch characters. Using this hammer face one obtains the advantage of high speed when printing standard pitch characters and yet one is able to print condensed pitch characters with the same printer.

The face of each hammer is divided into two sections. The first section of each hammer face is identical to the hammer face in a conventional single width hammer. The second section of each hammer face spans the width of two condensed pitch characters.

The hammers are divided into two groups. The first group of hammers has the single width section on the top of the hammer face and the second group of hammers has the single width section on the bottom of the hammer face. Hammers in the first and second groups alternate along the print line and the hammers are aligned so that single width section of all the hammer faces are in a straight line.

2 Claims, 4 Drawing Sheets

LOWER HAMMER
COMPRESSED TYPE

UPPER HAMMER
COMPRESSED TYPE

LOWER HAMMER
STANDARD TYPE

UPPER HAMMER
STANDARD TYPE

DUAL PITCH IMPACT PRINTER

TECHNICAL FIELD

The present invention relates to impact printers and more particularly to impact printers which have an engraved type band.

BACKGROUND OF THE INVENTION

Computer output printers either use engraved type elements or they produce each character from a series of dots. In printers which produce each character from a series of dots, condensed print can easily be accommodated by merely controlling the mechanism which prints the dots so that the resulting characters have the desired spacing and shape. One can therefore electronically switch from standard pitch printing to condensed pitch printing. With engraved type printers, one generally must mechanically change print elements to change from standard to condensed print. In some engraved type printers such as with band printers, the task of providing condensed print is more difficult.

In particular with the known band printers such as those marketed by International Business Machines Corporation under the type number designation 3262, 4245 and 4248 (or for example see IBM Technical Disclosure Bulletin, June 1978, Vol. 21 No. 1 page 101) one cannot do condensed print because the print hammers are physically spaced for standard pitch printing. If one tried to use a band in these printers which had condensed print characters engraved thereon, some of the print positions would fall between print hammers. Naturally one could build a printer with hammers that are positioned for condensed print, but such a printer would then not be able to efficiently print standard pitch characters.

Printers are known which have double wide print hammers. With an appropriate print band and appropriate control circuitry such printers can print condensed print and with a different print band and appropriate control circuitry such printers can print standard pitch characters. For example, see IBM Technical Disclosure Bulletin, Sept. 1974, Vol. 17 No. 4 page 1012. Another technique for printing condensed print characters is shown in U.S. Pat. No. 4,055,117 (Munday). These and other prior art techniques for printing condensed characters on a printer that can also print standard pitch characters suffer degraded throughput. In printers with double wide hammers throughput is degraded because the pitch of the characters on the band must of necessity be greater than the width of the hammers with the result that it takes longer for a complete character array to pass in front of each hammer. Furthermore, such printers require additional hammer settle out time before adjacent characters can be printed, thereby further degrading the performance. In printers such as that shown in U.S. Pat. No. 4,055,117 (Munday) additional cycles of the print band are required thereby degrading performance.

The prior art therefore shows band printers which have single width print hammers and band printers which have double width print hammers. There is no prior art which shows print hammers which combine a single wide section for printing standard pitch characters and double wide section for printing condensed pitch characters.

OBJECTS OF THE PRESENT INVENTION

The object of this invention is to provide a high speed printer which can print both standard and condensed print.

Another object of the present invention is to provide a print hammer face which can efficiently print both standard pitch characters and condensed pitch characters.

A further object of this invention is to provide a printer with engraved type which can print both standard and condensed print.

Another object of the present invention is to provide a printer which can print condensed print and which prints standard pitch printing at high speed.

Yet another object of this invention is to provide a high speed band printer which can print both standard and condensed print.

Still another object of the present invention is to provide a print hammer face which has the advantages of a single wide hammer face when printing standard print and the advantages of a double wide hammer face when printing condensed print.

Still another object of this invention is to provide a band printer which can either utilize a band which has only standard pitch characters, a band which only has condensed print characters or a band which has both condensed and standard pitch characters thereon.

A still further object of the present invention is to provided a band printer which can print both standard pitch and condensed pitch characters and which is economical to build because there are a relatively small number of different parts.

SUMMARY OF THE INVENTION

The present invention provides a print hammer face which has a single wide section for standard pitch characters and a double wide section for printing condensed pitch characters. Using this hammer face one obtains the advantage of high speed when printing standard pitch characters and yet one is able to print condensed pitch characters with the same printer.

The face of each hammer is divided into two sections. The first section of each hammer face is identical to the hammer face in a conventional single width hammer. The second section of each hammer face spans the width of two condensed pitch characters.

The hammers are divided into two groups. The first group of hammers has the single width section on the top of the hammer face and the second group of hammers has the single width section on the bottom of the hammer face. Hammers in the first and second groups alternate along the print line and the hammers are aligned so that single width section of all the hammer faces are in a straight line. The double width sections of the hammer faces alternate between being above and below this line.

The print band has two sections. One section has standard pitch characters and the second section has two rows of condensed print characters. (Alternately, there can be separate print bands, one with standard pitch characters and one with condensed characters.) The standard pitch characters on the print band are aligned with the single wide section of the hammer faces. One row of condensed pitch characters on the print band is aligned with the double wide section of the hammer faces in the first group of hammers and the second row of condensed pitch characters on the print band is aligned with the double wide section of the hammer faces in the second group of hammers.

In order to print standard pitch characters, the section of the print band which has standard pitch characters is used and the single width portion of each hammer face is used to print characters. Printing proceeds in a normal manner.

In order to print condensed pitch characters, the section of the print band which has condensed print characters is used and the double wide portion of each hammer face is used to print characters.

In order to print a complete line of condensed print, (a) first those characters which can be printed using the double wide section on the first group of hammers is printed, (b) next the paper is indexed so that this same print line is now aligned with the double wide section of the hammers in the second group of hammers and (c) then the remaining characters are printed.

The reason that printing condensed characters proceeds as described above is (a) the double width section of each hammer spans the width of two condensed print characters, (b) the standard pitch characters are approximately 1.5 times the width of condensed print characters and (c) the hammers are positioned at a spacing equal to the spacing of standard pitch characters. Therefore, one of the condensed print positions on the first group of hammers is aligned with one of the print positions on the second group of hammers but some print position can only be printed with either the top or the bottom row of hammers.

The foregoing and other objects, features and advantages of the invention will be apparent from the following more particular description of the preferred embodiments of the invention, as illustrated in the accompanying drawings.

DETAILED DESCRIPTION

Figure 1:
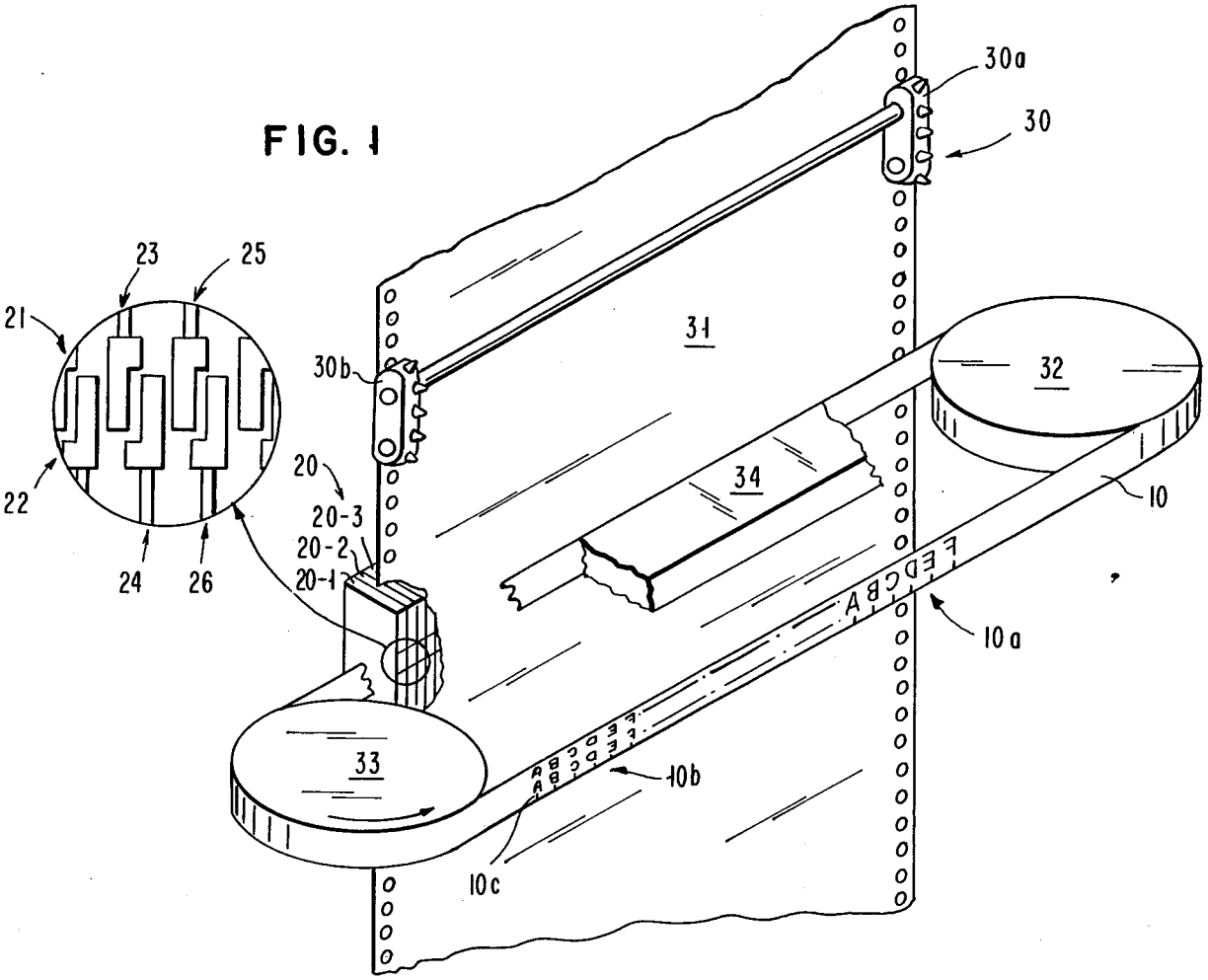
FIG. 1 shows the overall printer.

The overall structure of a printer built in accordance with the present invention is shown in FIG. 1. This printer is designed to print either standard ten pitch characters (10 characters per inch) or condensed fifteen pitch characters (fifteen characters per inch). A print band 10 moves in front of a bank of hammers 20. The hammers 20 can be conventional in design except for the shape of the hammer faces. For example, hammers 20 can be of the type shown in U.S. Pat. No. 4,269,117 (Lee). The hammers 20 are spaced on 0.1 inch centers as is conventional when printing standard 10 pitch characters. The bank of hammers is designated 20 and the individual hammers are designated 20-1, 20-2, 20-3, etc.

A conventional paper feed mechanism 30 moves paper 31 between hammers 20 and backing plate or platen 34. Paper feed mechanism 30 includes tractors **30*a* and 30*b* which are driven in a conventional manner. A conventional ribbon (not shown) is positioned between the paper 31 and the print band 10. Print band 10 has a conventional backing plate 34**.

The print band 10 has a first section designated **10*a* which has standard pitch characters engraved thereon. These characters are spaced on 0.133 inch centers. This is the conventional spacing used for ten pitch characters so as to avoid shadow printing. The print band 10 has a second section designated 10*b* which has two rows on condensed characters. The condensed characters are spaced on 0.1666 inch centers for printing 15 pitch characters with double wide hammers. Print band 10 has a row of conventional timing marks 10*c*. These timing marks are positioned to coincide with the position and spacing of the characters on print band 10**.

The print band 10 and paper 31 are cut away to show the print hammers 20. The shape and relative position of the hammer faces are shown in the expanded portion of FIG. 1. If the hammer faces where not shown in expanded fashion, they would not be visible in the scale of FIG. 1. The hammer face of hammer 20-1 is designated 21, the hammer face of hammer 20-2 is designated 22, etc.

Figure 2:
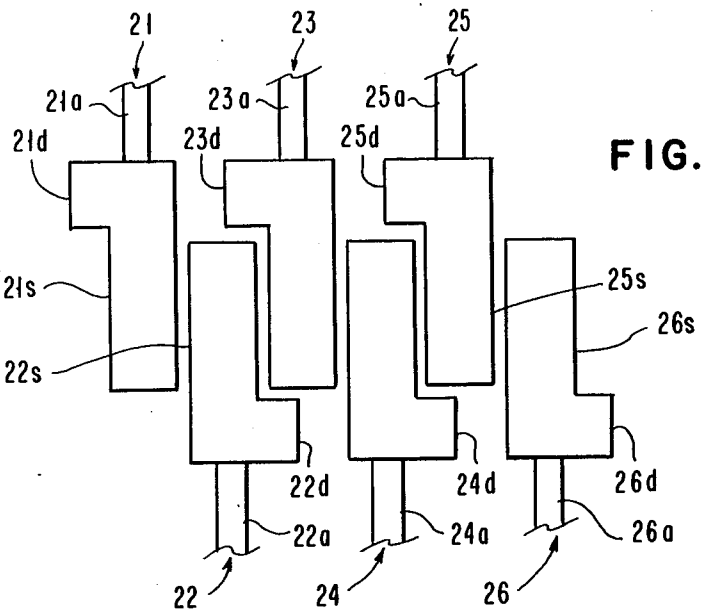
FIG. 2 shows hammer faces built in accordance with the first embodiment of the present invention.

FIG. 2 shows the detail shape of six print hammer faces designated 21, 22, 23, 24, 25 and 26. Hammer face 21 has a single wide section **21*s*, a double wide section 21*d* and a stem 21*a*. Hammer face 22 has a single wide section 22*s*, a double wide section 22*d* and a stem 22*a*. Hammers 23 to 26 have similar parts with similar designations. For clarity the various parts in FIG. 2 are not drawn to exact scale. The dimensions of the various parts of hammer 21** are given below.

Width of double wide section **21*d*** is 0.133 inches
Width of single wide section **21*s*** is 0.092 inches
Height of double wide section **21*d*** is 0.110 inches
Height of single wide section **21*s*** is 0.180 inches.

Space between:
single wide sections **21*s* and 22*s*** is 0.008 inches
double wide sections **21*d* and 22*s*** is 0.030 inches.

The dimensions of the parts of each of the other hammers is identical to that given above for hammer 21. Furthermore, the upper bank of hammers 21, 23, 25 etc. is identical to the lower bank of hammers 22, 24, 26 etc. making for fewer different part numbers and economy in manufacture.

Stem **21*a* of hammer 21** is connected to a conventional actuating element (not shown). The actuating element can be of the type shown in U.S. Pat. No. 4,269,117 (Lee). Likewise, the stem of each of the other hammers is connected to a similar actuating element.

Figure 3A:
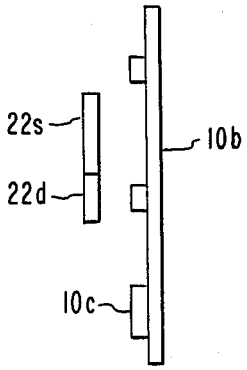
FIGS. 3A to 3D shows the relative position of the hammer face and the characters on the print band for various situations.
Figure 3B:
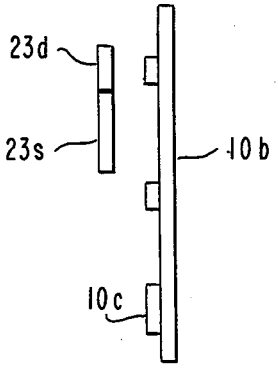

The manner in which the hammer faces interact with print band 10 to print standard pitch and condensed pitch character is shown in FIGS. 3A to 3D. For purpose of illustration hammer face 22 of the lower group of hammers and hammer face 23 from the upper group of hammers is shown. The alignment of the other hammers in the upper and lower groups is identical to that shown for faces 22 and 23. FIG. 3A shows how the double wide portion **22*d* on the bottom of hammer face 22 is aligned with the lower line of compressed type on band portion 10*b*. FIG. 3B shows how the double wide portion 23*d* on the top of hammer face 23 is aligned with the upper row of compressed type characters on print band 10*b*. It is noted that when the double wide sections 22*d* and 23*d* of hammers 22 and 23 are in position to print a character, the single wide sections 22*s* and 23*s* of hammers 22 and 23 are positioned so that they are not aligned with any characters on band 10**.

Figure 3C:
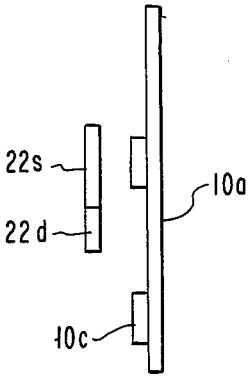
Figure 3D:
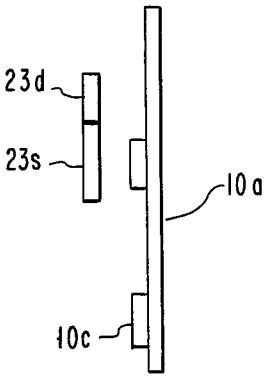

FIGS. 3C and 3D show how single wide sections 22s and 23s of hammers 22 and 23 are aligned with standard pitch characters on section 10a of print band 10. It is noted that when single wide sections 22s and 23s are aligned with characters on band section 10a, the double wide sections 22d and 23d of these hammers are not in a position to print a character.

The paper 31, printer ribbon, and backing plate 34 are not shown in FIGS. 3A to 3D as these are positioned conventionally.

The single wide sections 21s, 22s, etc. of all the hammers are aligned along a single print line and there is one hammer at each print position of a standard pitch character. That is, hammer face sections 21s, 22s, 23s, etc. are spaced at 0.10 inches so that there is a hammer face at each possible printed position, and an entire line of type can be printed while the paper 31 is in one position. This is conventional.

The following is a table which shows the hammer face section used to print at each print position of standard pitch print:

| Print Position | Hammer sections that align with this position |
|---|---|
| 1 | 21s |
| 2 | 22s |
| 3 | 23s |
| 4 | 24s |
| 5 | 25s |
| 6 | 26s |

The double wide sections 21d, 23d, etc. of the upper group of hammers 21, 23 etc. are aligned along one print line and the double wide sections 22d, 24d, etc. of lower group of hammers 22, 24, etc. are aligned along a different print line. Furthermore, as shown by the following table the upper group of hammers 21, 23, 25, etc. covers one group print positions for condensed print and the lower group of hammers 22, 24, 26, etc. covers a different group of print positions for condensed print:

| Print Position | Hammer sections that align with this position |
|---|---|
| 1 | 21d |
| 2 | 21d |
| 3 | 22d |
| 4 | 22d and 23d |
| 5 | 23d |
| 6 | 24d |
| 7 | 24d and 25d |
| 8 | 25d |
| 9 | 26d |

The reason for the particular pattern in the above table is that the print positions for condensed print are 0.06666 inches apart while the double wide sections 21d, 22d, etc. are 0.133 inches wide and they are separated by 0.067 inches.

In view of the above, a complete line of condensed print cannot be printed while paper 31 is at one print position. Instead, the particular print positions that can be printed by the lower group of hammers 22, 24, 26, etc. is first printed. Then, the paper 31 is incremented and any remaining characters are printed by the upper group of hammers 21, 23, 25, etc.

As an example, an explanation will now be given of how the present invention would operate to print the following line of condensed characters: Line to be printed:

Now is the time for all good men

Characters printed by bottom row of hammers 22, 24, etc.

```
w s he ti e or al g od me
```

Characters printed by top row of hammers 21, 23, etc.

```
No i t m f l o n
```

In the following explanation the print positions are designated as follows:

```
Now is the time for all good men        |  Characters
123456789012345678901234567890123       |  Print
        |         |         |           |  Positions
       10        20        30           |
```

In order to print this row of condensed characters the following characters will first be printed with the bottom row of hammers 22, 24, 26, etc.

```
w  s  he ti  e  or al g  od me          Characters
34 67 90 23 56 89 12 45 78 01 3   |     Print
      |        |        |        |     Positions
     10       20       30        |
```

Next, the paper will be incremented and the following characters will be printed with the top row of hammer faces 21, 23, 25, etc.

```
No  i t  m f  l o  n                    Characters
12  5 8 1 4 7 0 3 6 9 2           |     Print
        |       |       |       |     Positions
       10      20      30       |
```

As can be seen below, the combination of characters printed by the top and bottom rows of hammers print all necessary characters:

```
   w s  he ti  e or al g  od me         Bottom hammers
No i t  m f  l o  n                     Top hammers
Now is the time for all good men        Total
```

Figure 4:
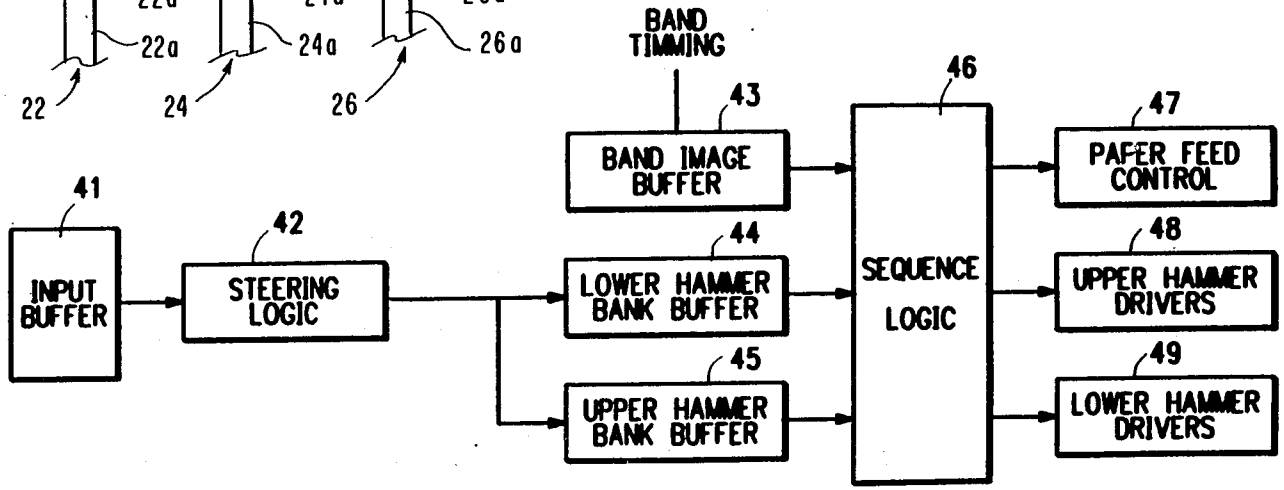
FIG. 4 shows the control circuitry for the first embodiment of the present invention.

The control circuitry for firing the hammers and for incrementing the paper is conventional logic circuitry. A block diagram of the logic circuitry is shown in FIG. 4.

Input Buffer 41 holds the line of data received to be printed. This data originated from a computer or other source of input (which is not shown). This is a conventional buffer. Steering Logic 47 receives the line of characters to be printed from buffer 41 and it sends any characters to be printed in print positions 1, 2, 5, 8, 11, 14, etc. to the Upper Hammer Bank Buffer 44 and it sends any characters to be printed in print positions 6,7,8,10,12,13,15, etc. to the Lower Hammer Bank Buffer 45.

Band Image Buffer 43 receives signals from band timing marks 10c and in a conventional manner keeps track of which characters on band 10 are in front of each hammer position. Sequence logic 46 first compares the characters which buffer 43 indicates can be printed at any time with the characters in lower hammer bank buffer 44 and as the band 10 passes the appropriate positions, these characters are printed. This is conventional. Next the Sequence Logic 46 activates Paper Feed Control 47 to increment the paper so that the paper is positioned such that the upper group of hammers 21, 23, 25, etc. are positioned to print on the same line on the paper. Sequence logic 46 then compares the characters which can be printed at any time to the characters in upper hammer bank 45 and activates the upper hammer bank drivers 48 at the appropriate time.

As described above, the amount that the paper is incremented between the time that the lower hammers print a line of characters and the time that the upper hammers print a line of characters is equal to the space between lines of print.

It is noted that if one wants to print on lines which are more closely spaced that the distance which the paper must be moved to print on the same line by the lower and upper groups of hammers, appropriate buffers can be provided so that the lower group of hammers can be printing characters for one line of printing while the upper group of hammers is printing while the upper group of hammers is printing characters for a different line of print. For simplicity as described herein it is assumed that there are no lines of characters in the space that the paper is incremented between printing with the lower and upper hammers.

It is also noted that the logic in FIG. 4 could include a microprocessor which calculates the optimum way in which to divide characters between the upper and lower bank of hammers. Such a microprocessor could be programmed to take into account the required settle time of the hammers and the location of the various characters on print band 10.

As described herein, print band 10 has two sections, one section for standard pitch printing, and one section for condensed pitch printing. One could also practice the present invention using two different print bands, one that had standard pitch characters and one that had condensed pitch characters. The disadvantage of using two print bands is that the band would have to be physically changed in order to change from standard pitch printing to condensed pitch printing.

Figure 5:
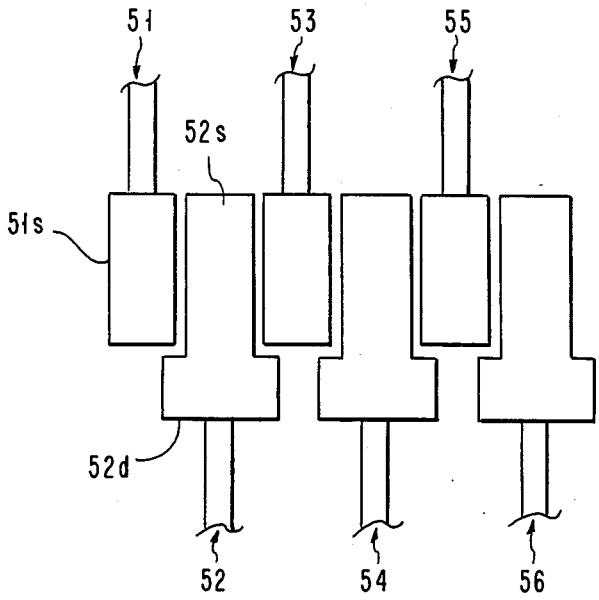
FIG. 5 shows a first alternate embodiment of the present invention.
Figure 6:
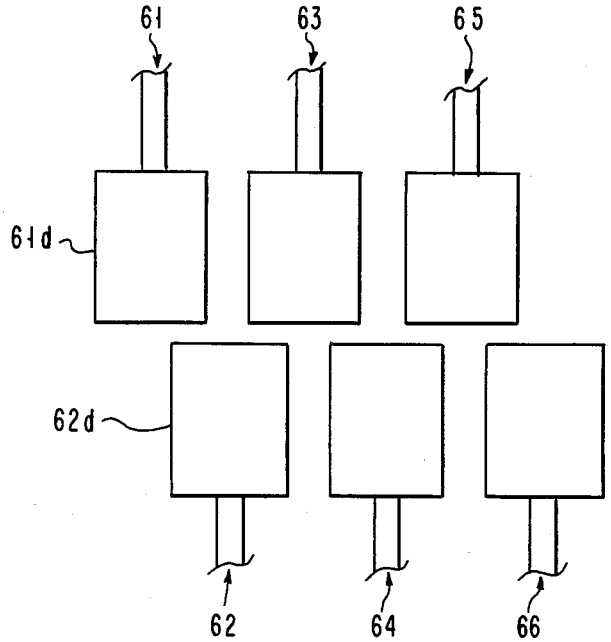
FIG. 6 shows a second alternate embodiment of the present invention.

Alternative embodiments of the present invention are shown in FIGS. 5 and 6. FIG. 5 shows an embodiment where the shape of the upper hammer faces differs from the shape of the lower hammer faces. The lower hammer faces 52, 54, 56, etc. are shaped similar to the hammer faces in the first embodiment, that is, they have two sections, one of which is one character wide and one of which is two characters wide. That is, the width of section **52*d* is identical to the width of section 22*d* and the width of section 52*s* is identical to the width of section 22*s*. The upper group of hammer faces only have a single section which is similar to the single width section of the hammers in the first embodiment. That is, section 51*s* is similar to section 21*s*. The spacing between the hammer faces is similar to the spacing between the hammer faces in FIG. 2**.

The embodiment shown in FIG. 5 prints standard pitch characters in exactly the same way that the embodiment in FIG. 2 prints standard pitch characters. The manner in which it prints condensed print characters is different.

In the embodiment shown in FIG. 2, when printing condensed characters and using a simple form of control logic, all of the characters printable by the lower hammers were printed prior to printing any characters using the upper row of hammers. In this mode of operation, only half of each upper hammer face is ever used (except for the first hammer. The embodiment in FIG. 5 takes advantage of this and only provides a narrow face on each hammer in the upper group. It is noted that in a more complex mode of operation of the embodiment shown in FIG. 2, that is, in an embodiment where a microprocessor determines the optimum division of printing between the upper and lower hammer faces, all sections of all hammer faces are used.

The alternate embodiment in FIG. 6 has the advantage that all hammer faces are identically shaped and simpler in shape than the hammer faces shown in FIG. 2. This embodiment has the disadvantage that throughput is reduced when printing standard pitch print.

In the embodiment shown in FIG. 6, all hammers only have a double wide section. It is noted that these hammers are not conventional double wide hammers in that they are spaced at a pitch identical to the pitch of standard pitch printing.

In order to print standard pitch printing with the embodiment shown in FIG. 6, the bottom hammers are first used to print characters in alternate positions along the print line (that is, print two, skip one as in the embodiment shown in FIG. 2). The paper is then incremented and the remaining characters are printed using the upper group of hammers.

In order to print condensed print using hammer faces such as those shown in FIG. 6, one can print in two possible positions with each lower hammer face similar to the way that each lower hammer face in the embodiment in FIG. 2 could print in two possible print positions. The difference is that each upper hammer in the embodiment shown in FIG. 6 is positioned so that it can only print in one possible condensed print position. The reason for this is that the hammers in the embodiment shown in FIG. 6 are as wide as sections **21*d*, etc. in FIG. 2, and the hammers are spaced the same distance apart as share hammers 21, 23, 25 etc. Hence, each upper hammer can only print in one condensed print position. With this embodiment, the print line for the upper group of hammers can be closer to the print line for the lower group of hammers than is the situation with the hammer faces shown in FIG. 2**.

While the invention has been particularly shown and described with reference to the preferred embodiments thereof, it will be understood by those skilled in the art that various changes in form and details may be made therein without departing from the spirit and scope of the inventions.

We claim:

1. A printer with first and second groups of print hammer faces wherein members of said first group alternate with members of said second group, each of said hammer faces having a single wide section for printing standard pitch characters and a double wide section for printing condensed pitch characters, said first group having said double wide section on top of said hammer face and said second group having said double wide section on the bottom of said hammer face, each of said single wide sections being aligned to print a row of standard pitch characters, said double wide sections in said first and second groups being positioned to print in all compressed character positions.

2. A printer having a plurality of print hammer faces, a rotating print band having standard pitch and condensed pitch characters, and a movable print receiving print medium, each of said print hammer faces having a single wide section for printing standard pitch characters and a double wide section for printing condensed pitched characters, said print hammer faces being divided into first and second groups, members of said first group alternating with members of said second group along a print line, said first group having said double wide section on top of said hammer face and said second group having said double wide section on the bottom of said hammer face, said hammer faces being spaced at a pitch equal to standard pitch characters, all of said single wide sections being aligned to print a row of standard pitch characters, said double wide sections in said first group being positioned to print on a first condensed print line, said double wide sections in said second group being positioned to print on a second condensed print line, means to move said print receiving medium between said first condensed print line and said second condensed print line, whereby the combination of hammer faces in said first and second group can print at any condensed print position.

* * * * *